United States Patent [19]

Fusco

[11] 4,044,033

[45] Aug. 23, 1977

[54] HIGH TEMPERATURE LUBRICANT

[75] Inventor: Anthony M. Fusco, Spartanburg, S.C.

[73] Assignee: Milliken Research Corporation, Spartanburg, S.C.

[21] Appl. No.: 568,047

[22] Filed: Apr. 14, 1975

[51] Int. Cl.[2] ..... C07C 103/127; C07C 103/133

[52] U.S. Cl. ..... 260/404; 260/561 R; 260/561 N; 252/8.8 AL; 252/8.8 AM; 260/558 R; 260/410; 260/469; 260/478

[58] Field of Search ..... 260/404, 561 R, 561 N; 252/8.8 AL, 8.8 AM

[56] References Cited

U.S. PATENT DOCUMENTS

| | | | |
|---|---|---|---|
| 2,670,345 | 2/1954 | Mehltretter et al. | 260/561 B |
| 2,991,296 | 7/1961 | Scherr | 260/404 |
| 3,526,657 | 9/1970 | Loeffler | 260/561 R |
| 3,944,675 | 3/1976 | Symchowicz | 260/404 X |

FOREIGN PATENT DOCUMENTS

| | | | |
|---|---|---|---|
| 469,330 | 9/1971 | Japan | 260/404 |

*Primary Examiner*—Patrick P. Garvin

*Attorney, Agent, or Firm*—G. Mike Burdick; H. William Petry

[57] ABSTRACT

A high temperature lubricant comprising a gem disubstituted cyclic compound in which one radical is a short chain alkyl group and the other radical is a methylene group substituted by an alkyl, alkylene or aryl amido radical or an alkyl, alkylene or aryl carboxylate radical.

7 Claims, No Drawings

HIGH TEMPERATURE LUBRICANT

This invention relates to high temperature lubricants, that is, lubricants which do not decompose when utilized at high temperatures. More particularly, the invention relates to textile lubricants which exhibit such high temperature characteristics.

Many high temperature textile processing operations require the use of lubricants to reduce the friction between filaments or yarns and various other surfaces. For example, in the hot drawing of filament bundles to orient the fibers, it is desirable to employ a lubricant. Also, in the texturing of yarns to provide stretch characteristics, it is important to employ a yarn lubricant. Lubricants reduce yarn breaks which result in excessive machine stoppage.

For lubricants to be successful in high temperature textile processing operations, it is essential that they do not decompose at the elevated operating temperatures. Such decomposition may be apparent by the evolution of smoke and/or the formation of gummy or charred residues on the filaments or yarns and on the equipment used. A further requirement is the presence of a high degree of friction reduction as well as the absence of reactivity with the yarns. Also, it is advantageous that the lubricant be removed easily from the yarns.

The formation of smoke is undesirable because of the pollution of the environment surrounding the textile machines. Residue build up on the equipment necessitates frequent shut downs for machine cleaning. The formation of residues on the filaments or yarns may require that the yarns be discarded or at least require extra yarn cleaning operations. When such residues are not detectable until after the yarns are knitted or woven into fabrics, it may be necessary to downgrade or reject the entire fabric because of the presence of a few bad yarns therein.

Heretofore, it has been proposed to employ various fatty acid esters such as butyl stearate in high temperature textile applications, but these materials do not exhibit sufficiently high temperature resistance to smoking and/or residue formation. Also, it has been proposed in U.S. Pat. No. 3,464,922 to employ trimethylolalkane mixed esters. While such esters show improvement over the fatty acid esters, they are not easily removed from yarns unless they are combined with emulsifying agents. However, it is difficult to select an emulsifying agent which not only is compatible with the lubricant, but which will not lower the smoke point of the lubricant composition.

The present invention provides a novel lubricant which exhibits good friction reduction at high temperatures without forming smoke and/or other decomposition products.

The novel high temperature lubricant of the present invention comprises a gem disubstituted cyclic compound in which one radical is a short chain alkyl group and the other radical is a methylene group substituted by an alkyl, alkylene or aryl amido radical or an alkyl, alkylene or aryl carboxylate radical.

Advantageously, the ring portion of the gem disubstituted cyclic lubricant of the invention has 5 to 7 carbon atoms and preferably the ring structure is a saturated ring. In addition to the short chain alkyl group (preferably about 1 to 6 carbon atoms) in the gem disubstitution, it is desirable that at least one additional short chain alkyl group is attached to the ring structure.

The alkyl, alkylene or aryl groups on the amido or carboxylate radicals advantageously contain between about 3 and 20 carbon atoms and preferably between about 6 and 18 carbon atoms. High resistance to decomposition or degradation of the lubricant is achieved when between about 12 to 18 carbon atoms are present in the alkyl, alkylene or aryl group.

The gem disubstituted cyclic compound of the invention may be rendered water dispersible or water soluble by reacting the compound with an alkylene oxide such as ethylene oxide or propylene oxide to form a polyalkyleneoxy chain on the ring structure. The polyalkyleneoxy chain is attached to a ring carbon through a functional group such as a hydroxyl group. Advantageously, the ring carbon also has a hydrogen atom. The polyalkyleneoxy chain preferably has at least two alkyleneoxy units therein up to ten or more units, with the upper limit not being critical. As the number of alkyleneoxy units increases above the point of water solubility, there is a tendency for the high temperature properties to diminish.

Useful gem disubstituted cyclic lubricants of the present invention may be represented by the formula

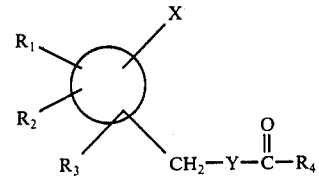

wherein $R_1$ and $R_2$ are hydrogen or a lower alkyl group, $R_3$ is a lower alkyl group $R_4$ is an alkyl, alkylene or aryl group X is a polyalkyleneoxy chain Y is oxygen or NH Advantageously, the ring is a saturated ring structure with six carbon atoms, $R_1$, $R_2$ and $R_3$ are methyl groups, $R_4$ is an alkyl or alkylene group, X is a polyethyleneoxy chain and Y is NH.

Compounds of this type may be prepared from isophorone utilizing the methods described in U.S. Pat. Nos. 3,270,044 and 3,352,913 to form an amino methyl cyclohexanol which is then reacted with a carboxylic acid in a fusion cook by heating stoichiometric quantities of the amine and the acid until molten and stirring the molten mixture with a nitrogen sweep to drive off water vapor. The progress of the reaction is stopped when an acid number just below theoretical is obtained. Similarly, the carboxylate derivative can be formed from a hydroxymethyl cyclohexanol.

An ethoxylated product is prepared by adding ethylene oxide to molten gem disubstituted cyclic amine in the presence of potassium hydroxide catalyst in an autoclave at 290°-300° F. As the ethoxylation continues, the reaction mixture becomes more fluid and the product becomes water dispersible. Further ethoxylation results in a water-soluble product.

Various gem disubstituted cyclic compounds are prepared according to the above procedures and tested to determine their lubricant properties at high temperatures. The compounds are tested to determine their coefficient of friction and to determine their smoke point and flash point.

The lubricity of the compounds is determined by applying the lubricants to scoured and dried spun polyester test yarn from Test Fabrics, Inc. using an Atlab Finish Applicator. Water dispersible lubricants are applied from aqueous solutions with a 1% and 3% dry pickup. Lubricants which are not dispersible in water are applied from isopropanol solutions in the same manner. Friction testing is conducted with a Rothchild F-Meter using recommended procedures. To test the yarns at 410° F, the Rothchild Test Meter is fitted with a Fycon Type T-5 Pin Heater Assembly manufactured by Fycon Engineering Corporation. A $\frac{7}{8}$ inch wear sleeve without a finished surface is used with the pin heater. The yarn is conducted through the apparatus at a rate of 50 meters per minute with a contact angle of 180°.

The smoke point and flash point are determined according to American Oil Chemical Society Official Method (c-9*a*-48).

The following tables are listings of comparisons of lubricants of the invention with a commercially available lubricant.

TABLE I

| | Coefficient of Friction | | Smoke Point | Flash Point |
|---|---|---|---|---|
| | 1% | 3% | | |
| Solvent Treated Control | 0.77 | 0.50 | — | — |
| TMP Ester[1] | 0.68 | 0.42 | 185° F | 295° F |
| TMC Oleamide[2] - 5EO | 0.73 | 0.43 | 165 | 277 |
| TMC Stearamide[2] - 5EO | 0.72 | 0.43 | 140 | 264 |

[1]Trimethylolpropane mixed fatty ester sold by Pacific Vegetable Oil.
[2]3,5,5,-Trimethyl cycloamide with 5 ethyleneoxy units made from 1-hydroxy-3-aminomethyl-3,5,5-trimethylcyclohexane sold by Veba Chemie and a commercial grade oleic acid sold by Westvaco or a commercial grade stearic acid sold by Humko Sheffield Corp.

TABLE II

| | Coefficient of Friction | |
|---|---|---|
| | 1% | 3% |
| Solvent Treated Control | 0.55 | 0.55 |
| TMP Ester[1] | 0.36 | 0.35 |
| TMC Lauramide[2] - 2EO | 0.39 | 0.40 |
| TMC Adipamide[2] - 2EO | 0.41 | 0.42 |

[1]Trimethylolpropane mixed fatty ester sold by Pacific Vegetable Oil.
[2]3,5,5,-Trimethyl cycloamide with 2 ethyleneoxy units made from 1-hydroxy-3-aminomethyl-3,5,5-trimethylcyclohexane sold by Veba Chemie and a laboratory grade carboxylic acid sold by Fischer Scientific.

From the above discussion and comparisons, it is apparent that the present invention provides a novel lubricant which exhibits good friction reduction at high temperatures. Furthermore, the lubricant of the invention does not form smoke or leave residues on filaments or yarns or on the equipment used. A particularly important advantage of the lubricant of the invention is that it is water dispersible so that it can be removed easily from yarns or filaments. This is important since lubricant retention may cause problems in subsequent fabric finishing and/or dyeing due to unevenness, etc. Thus, the present invention provides a lubricant which is useful in high temperature operations such as hot drawing, texturizing, open end spinning and the like.

It will be apparent that various modifications in the lubricant disclosed may be made within the scope of the invention. For example, the polyethyleneoxy chain may be a polypropyleneoxy chain. Therefore, the invention is to be limited only by the following claims.

That which is claimed is:

1. A high temperature lubricant comprising a gem disubstituted alicyclic compound in which the ring portion of said compound is cycloaliphatic hydrocarbyl and contains from about 5 to about 7 carbon atoms and said compound is represented by the formula

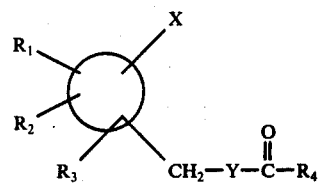

wherein $R_1$ and $R_2$ are H or a lower alkyl group, X is a polyalkyleneoxy chain, and the gem radicals are $R_3$ and

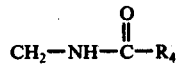

wherein $R_3$ is an alkyl group containing 1 to about 6 carbon atoms and $R_4$ is an alkyl or alkylene group containing about 3 to about 20 carbon atoms.

2. The lubricant of claim 1 wherein X is a polyalkyleneoxy chain containing at least about two alkyleneoxy units.

3. The lubricant of claim 2 wherein the alkyl or alkylene group of $R_4$ contains from about 6 to about 18 carbon atoms.

4. The lubricant of claim 3 wherein the alkyl or alkylene group of $R_4$ contains from about 12 to about 18 carbon atoms.

5. The lubricant of claim 4 wherein the ring portion of said compound contains 6 carbon atoms.

6. The lubricant of claim 5 wherein $R_1$, $R_2$ and $R_3$ are methyl groups.

7. The lubricant of claim 6 wherein X is a polyethyleneoxy chain containing about 5 ethyleneoxy units and $R_4$ is a alkyl group containing about 17 carbon atoms.

* * * * *